United States Patent [19]

Strombeck et al.

[11] 4,077,188

[45] Mar. 7, 1978

[54] APPARATUS FOR APPLYING COVERS TO CONTAINERS

[75] Inventors: Leo Strombeck; Ralph F. Anderson, both of Rockford, Ill.

[73] Assignee: Anderson Bros. Mfg. Co., Rockford, Ill.

[21] Appl. No.: 774,875

[22] Filed: Mar. 7, 1977

[51] Int. Cl.[2] ..... B65B 7/28

[52] U.S. Cl. ..... 53/310; 53/314; 221/273

[58] Field of Search ..... 53/310, 313, 314, 315, 53/316; 221/273; 113/114 BA

[56] References Cited

U.S. PATENT DOCUMENTS

| | | | |
|---|---|---|---|
| 1,964,078 | 6/1934 | Podel | 53/313 X |
| 2,734,673 | 2/1956 | Hazel | 53/316 X |
| 3,100,957 | 8/1963 | King et al. | 53/313 X |
| 3,460,314 | 8/1969 | Keas | 53/316 X |
| 3,977,161 | 8/1976 | Faber et al. | 53/313 |

*Primary Examiner*—Leon Gilden
*Attorney, Agent, or Firm*—Morsbach & Pillote

[57] ABSTRACT

An apparatus for applying covers to containers as they are advanced by a conveyor in spaced succession past a cover applying station, the cover applying apparatus including a cover magazine that supports the bottom cover in the magazine in an inclined plane that converges toward and intersects the path of travel of the tops of the containers, with a shuttle driven in timed relation with the conveyor to move the bottom cover along the inclined plane across the magazine and onto the containers as they are advanced, the drive for the cover shuttle being so constructed and arranged that the forward velocity and displacement of the cover is approximately equal to the forward velocity and displacement of the container while the lead edges of the cover and container move past the point at which their paths intersect.

8 Claims, 12 Drawing Figures

10
105a
82a
105
78
79
104
K
65
123
121
81
82
102b
84
61
64
28
75
61d
69
68
75a
61b
116
115
102
48
52
55
51
21
C
99
102a
95
62a
63
103
91d
97
98
91c
91e
62
30°
70°
92a
92b
91f
91b
92
91
124
100°
91g
91a

K
43b
43
43a1
43c
42
43a
39a
39b
52
48
39
C 61
61b
K
61a
43b
43
43a1
39a
39b
43c
42
43a
52
48
39
C

K
43b
43
43a1
39a
39b
43c
42
43a
52
48
39
C 6
105a
78
79
78
82
84
81
105
98
82a
61d
75
64
65
102
61
68
75a
95
92
62
61a
96
71
71
116
52
48
91
97
115
28
51
6

360°
310°
280°
210°
180°
150°
80°
50°
0°
Sa
Sg
SHUTTLE
Vc
Sf
Se
Sd
Sc
LID
K
Sb
Sa
LEAD EDGE OF CONTAINER
Vc
DISPLACEMENT
1 PITCH

360°
360°
310°
280°
210°
180°
150°
80°
50°
0°
Sa
Sg
Sf
Vc
Sd
Se
SHUTTLE VELOCITY
Sc
Sb
CONTAINER VELOCITY
Sa
0°
VELOCITY

APPARATUS FOR APPLYING COVERS TO CONTAINERS

BACKGROUND OF THE INVENTION

Cover applying apparatus have heretofore been made in which covers from a magazine are fed or dispensed into an inclined chute which supports the covers in a downwardly inclined position with the lower edge in the path of travel of containers as they are advanced along a conveyor so that the containers engage the inclined covers and remove or strip the lowermost cover from the chute. Some examples of such cover dispensing apparatus are shown in U.S. Pat. Nos. 2,734,673; 3,100,957 and 3,460,314. In the cover dispensing apparatus of the type described above, the containers must engage and exert sufficient force on the covers in the chute to overcome the resistance of the cover stop at the lower end of the chute and accelerate the covers with the container. This requires that the containers be sufficiently rigid to withstand the forces encountered and moreover requires very firm support of the containers on the conveyor to prevent tipping or dislocation of the containers on the conveyor. Further, in such cover applying apparatus, the covers are advanced by gravity down the chute to the cover stop at the lower end of the chute. If the containers are advanced in closely spaced succession by the conveyor, there is very little time after removal of one cover for the next cover to advance into position. Reliance upon gravity alone to advance the cover into the cover applying position limits the maximum speed at which such cover applying apparatus can operate. Further, while such cover applying apparatus are adapted for handling covers of the type having a depending peripheral flange which can be engaged by the advancing container, such apparatus are not satisfactory for applying covers that do not have a depending peripheral flange.

It has also been proposed, for example as shown in U.S. Pat. Nos. 3,282,025 and 3,440,794, to use a rotary type or endless conveyor type cover applying apparatus having a plurality of cover engaging fingers arranged to engage the upper side of a cover and advance the same along a path that intersects the container path to apply the covers to the containers. Such rotary or endless conveyor type cover applying mechanism, however, are relatively complex and expensive to make and operate.

It has also been proposed, for example, as shown in U.S. Pat. No. 3,040,494, to provide a cover applying apparatus in which the covers are stored in an upright stack above the path of movement of the container conveyor and the container conveyor has dogs associated with each container advancing pocket for stripping the lowermost lid off the magazine and for advancing the lowermost lid with the container until it drops onto the container. This complicates the conveyor construction by requiring a special dog or similar element for each container receiving pocket on the conveyor. Moreover, the aforementioned cover applying apparatus merely strips the lowermost cover from the magazine and then allows the cover to drop by gravity onto the container.

SUMMARY OF THE INVENTION

It is the general object of the present invention to overcome the disadvantages of the prior art by providing a cover applying apparatus which effects positive feeding of a cover from the cover magazine along a path that intersects the path of movement of the tops of the containers on a conveyor and at a speed substantially equal to the speed of the containers to bring the covers into interfitting relation with the mouth of the containers. The cover applying apparatus can be used to apply covers of the type in which the peripheral container engaging rim does not extend below the mouth spanning portion of the cover. Further, the cover applying apparatus can be operated at high speeds since the covers are positively advanced from the magazine into mating engagement with the containers while the containers are in motion.

Accordingly, the present invention provides an apparatus for applying covers to containers while they are advanced in spaced succession along a container path by a conveyor, the cover applying apparatus including a magazine having a cover support which supports the bottom cover with its underside in an inclined plane that converges toward the tops of the containers, a shuttle mounted for reciprocation along a path paralleling the inclined plane to move the bottom cover in the magazine along the inclined plane and into an interfitting engagement with the top of a container while the latter is advanced by the conveyor, and shuttle drive means constructed and arranged to drive the shuttle so that the forward velocity and displacement of the lead edge of the cover is approximately equal to the forward velocity and displacement of the lead edge of the container while they move into interfitting engagement.

These, together will other objects, features and advantages of the invention will be more readily understood by reference to the following detailed description, when taken in connection with the accompanying drawings wherein.

Figure 1:
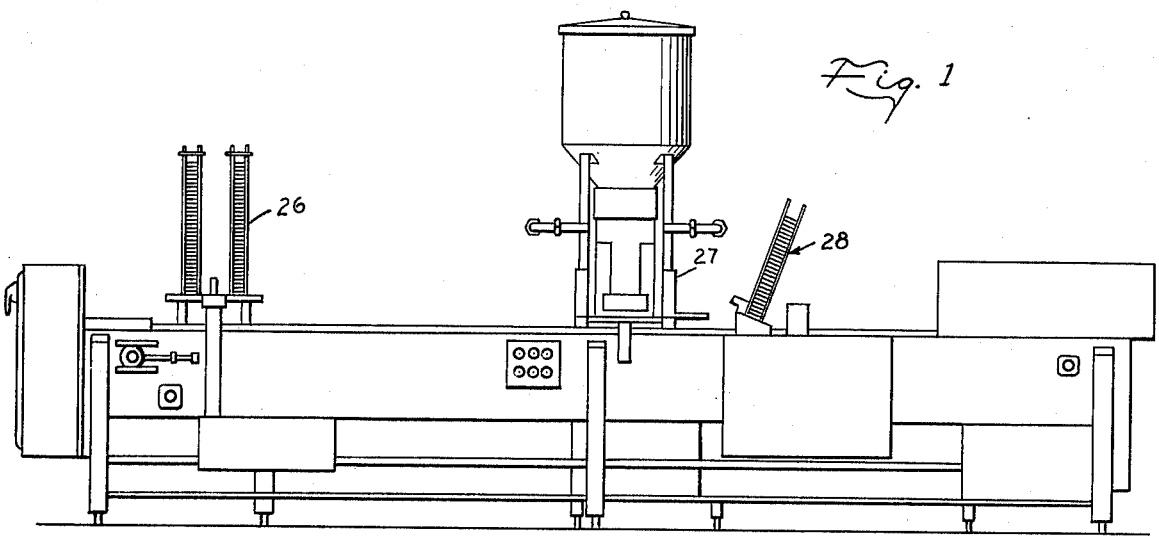
FIG. 1 is a side elevational view of a packaging machine embodying the cover applying apparatus of the present invention.
Figure 2:
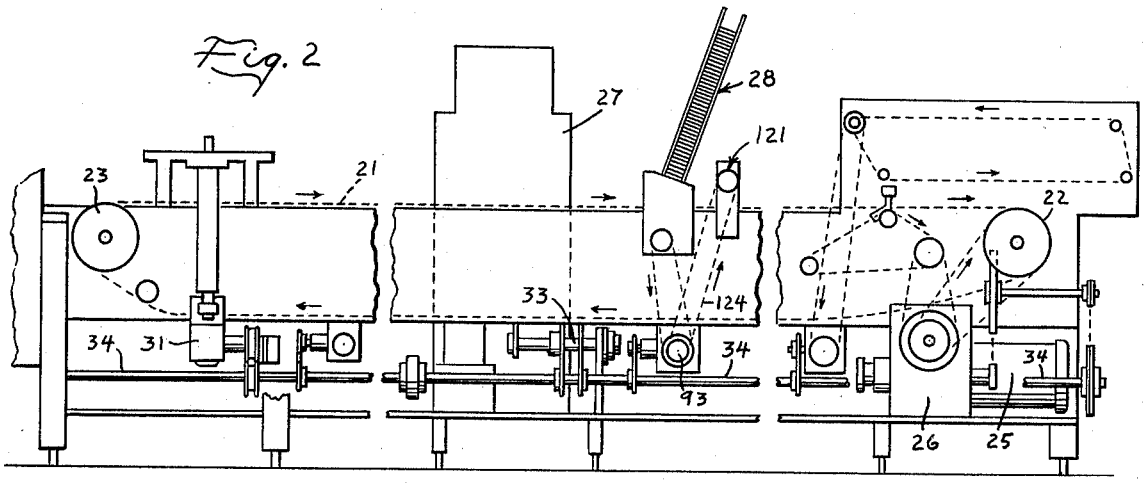
FIG. 2 is a rear elevational view of the packaging machine.

The cover applying apparatus of the present invention is generally adapted for use in applying covers to containers as they are advanced either in continuous or in intermittent fashion along a path and may, for example, be used in conjunction with a packaging machine as shown in FIGS. 1 and 2. The packaging machine includes a pocketed conveyor 21 of the endless type which is entrained over sprockets 22 and 23 adjacent opposite ends of the machine and which conveyor is driven preferably in continuous fashion as by motor 24 through a speed reducing drive mechanism 25. As shown in FIG. 1, a container dispenser 26, a filler 27 and a capper 28 are disposed at spaced stations along the conveyor to sequentially dispense containers into the pockets, fill the containers, and apply covers to the filled containers. The container dispenser and filler may be of any conventional construction, details of which form no part of the present invention. However, both are preferably driven in timed relation with the movement of the conveyor. As shown, the container dispenser is driven through a drive mechanism 31 from a main drive shaft 34 to dispense containers into the pockets in timed relation with the movement of the pockets past the container dispenser. The filler 27 is also operated in timed relation with the conveyor as by a drive mechanism 33 operatively connected to the main shaft 34 which extends lengthwise of the filling machine.

Figure 7:
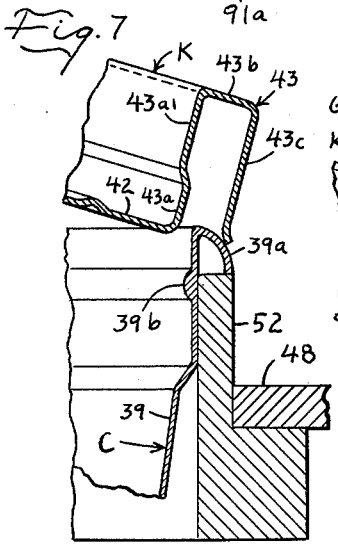
FIGS. 7, 8 and 9 are fragmentary sectional views through the container and cover illustrating different stages in applying the cover to the container.
Figure 8:
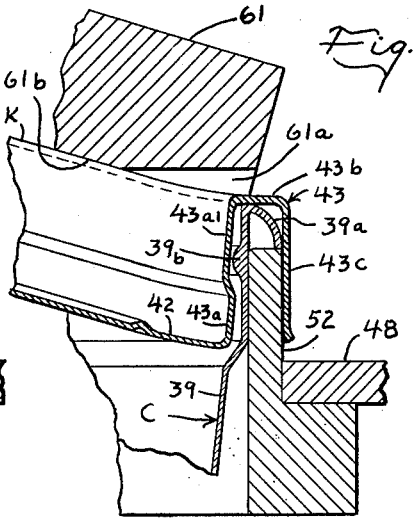
Figure 9:
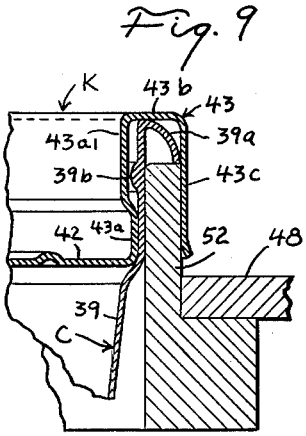

While the capping apparatus of the present invention is generally adapted for applying flanged covers to containers, it is particularly adapted for use in applying covers of the type shown in FIGS. 7–9 in which the covers *K* have a central mouth spanning portion 42 and a peripheral rim 43 defining a downwardly opening generally U-shaped channel. As shown in FIGS. 7–9, the rim 43 has an inner wall portion 43*a* that extends upwardly from the mouth spanning portion; a top wall portion 43*b* adapted to overlie the container wall, and an outer wall portion 43*c*. The container *C* has a bottom wall and a marginal side wall 39 of preferably circular configuration and which terminates at its upper end in a rim 39*a*. The U-shaped rim 43 on the cover is adapted to snap over the rim 39*a* on the mouth of the container. In the specific container shown in FIGS. 7–9, the wall 39 has an inwardly extending bead 39*b* and the inner wall 43*a* of the cover rim has an offset portion 43*al* adapted to receive the bead 39*b* when the cover is in position on the container, to releasably lock the cover to the container.

Figure 6:
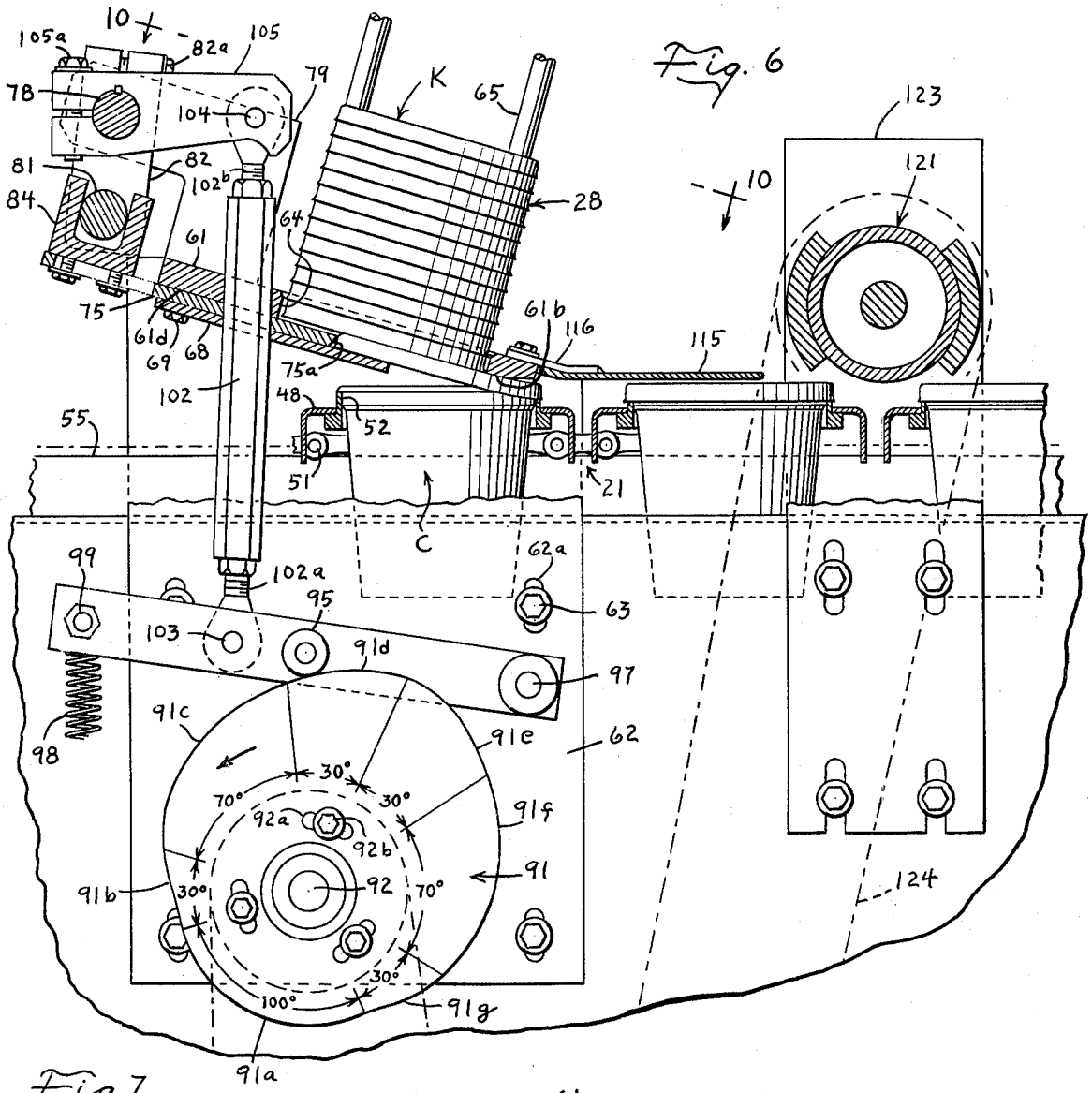

The container receiving pockets on the conveyor 21 are advantageously constructed and arranged to firmly support the containers adjacent the tops thereof as the containers are advanced to the machine and pass the cover apparatus. As best shown in FIG. 6, the container receiver pockets on the conveyor are in the form of trays 48 connected to the endless conveyor chains 51, and the trays have container receiving openings therein with upwardly extending flanges 52 around the openings and arranged to closely surround the side walls 39 of the container and to underlie the container rim 39*a* to firmly support the containers adjacent their upper ends. The conveyor chains 51 are in turn supported on guide rails 55 as they move past the cover applying station so that the conveyor supports the containers C with the upper rims of the containers at a preselected plane designated CP in FIG. 4, as the containers move past the cover applying station.

Figure 4:
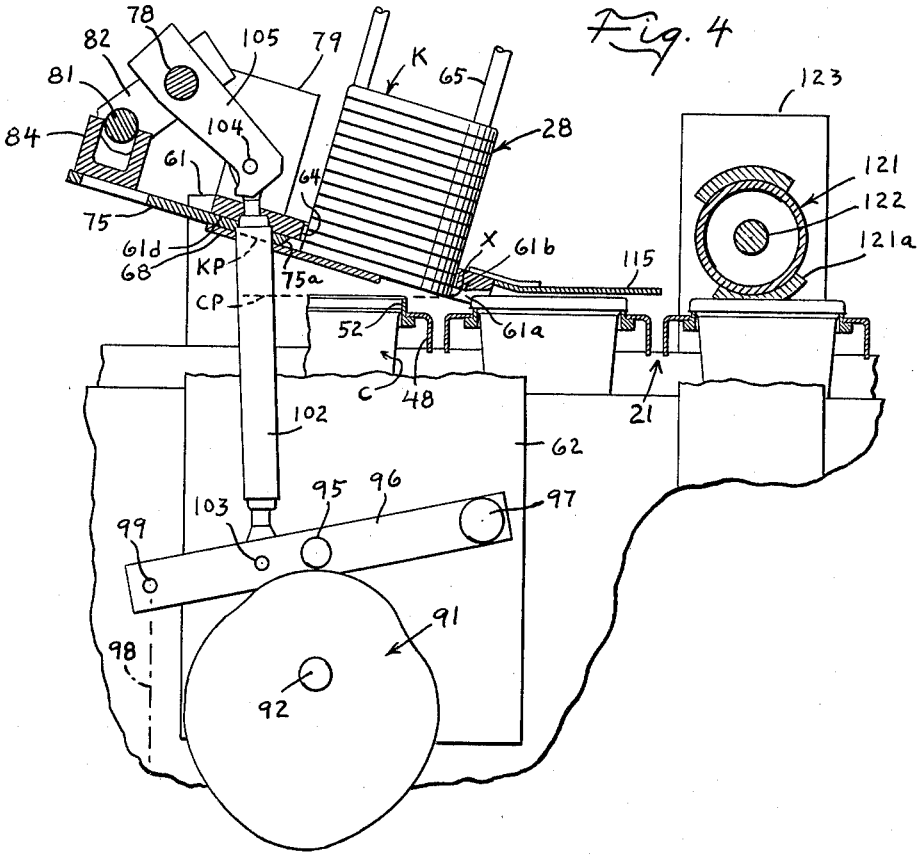
FIGS. 4, 5 and 6 are fragmentary side elevational views of the cover applying apparatus with parts broken away and illustrating the parts in different moved positions.
Figure 5:
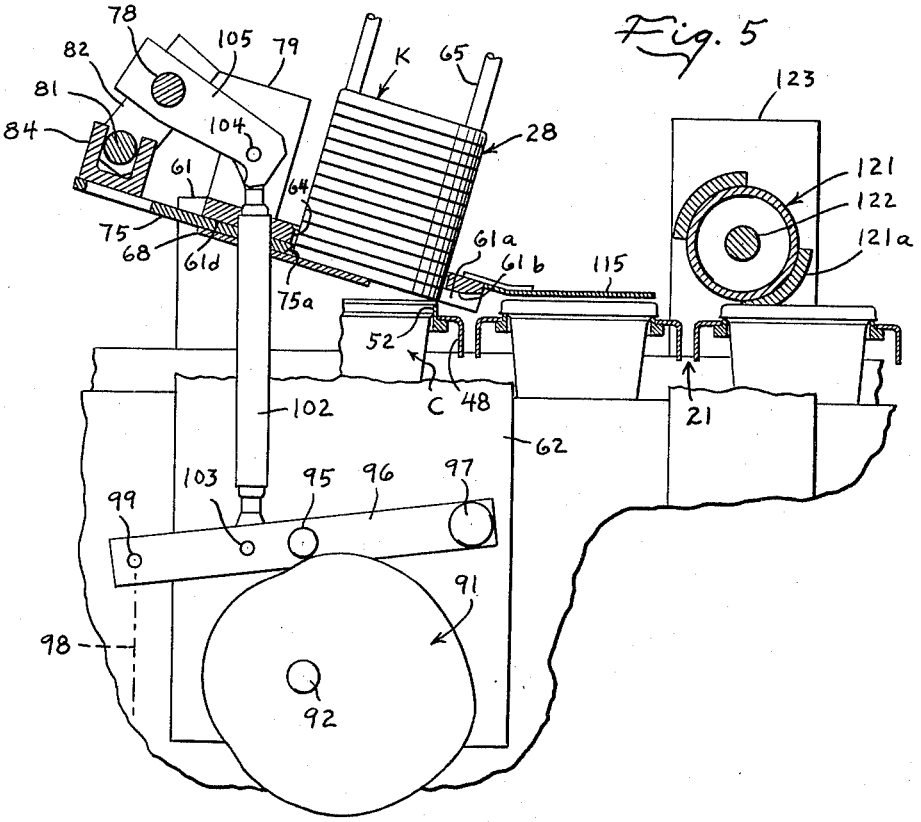
Figure 10:
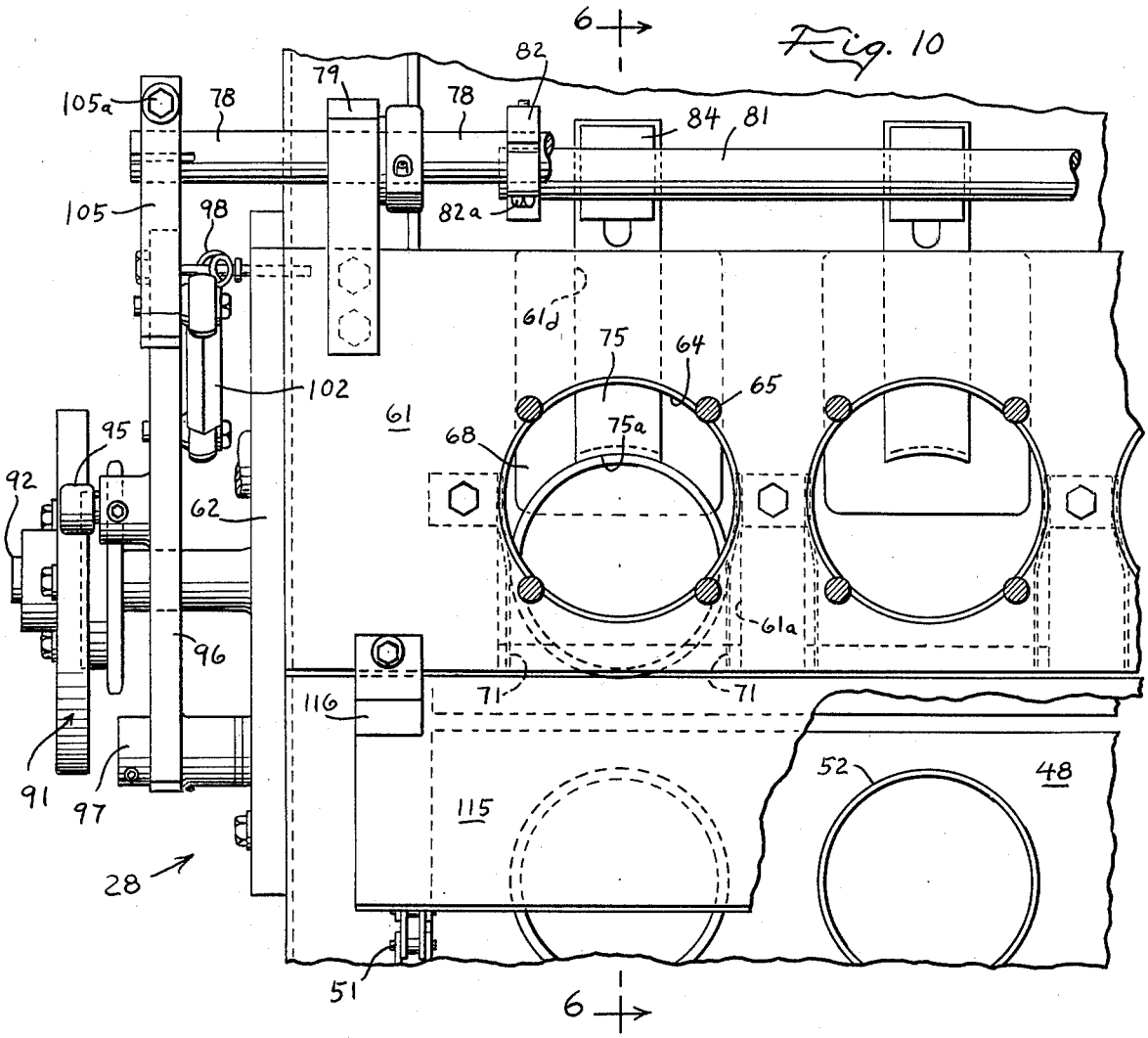
FIG. 10 is a fragmentary horizontal sectional view taken on the plane 10—10 of FIG. 6.

The cover applying apparatus 28 can be used with single or multi-lane machines and is herein shown applied to a multi-lane machine having a plurality of sidewise aligned lanes. The cover applying apparatus includes a magazine for supporting a stack of covers for each lane of the machine, with the covers in their normal position, that is with their U-shaped rims opening downwardly. The cover magazine includes a base plate 61 that extends crosswise of the machine and is supported adjacent opposite ends by mounting plates 62. The base plate 61 is arranged so that it converges at a shallow acute angle relative to the container plane CP and the mounting plates 62 are supported on the sides of the packaging machine as by bolts 63 that extend through vertially elongated openings 62*a* in the support plates, for limited vertical adjustment of the container magazine relative to the conveyor 21 and container plane CP. The base plate 61 has cover receiving openings 64 therein, one for each lane of the packaging machine, and which openings are dimensioned slightly larger than the size of the covers to allow the covers to pass downwardly therethrough. Stack guide rods 65, herein shown four in number, are attached to the base plate 61 around each of the openings to support and guide the stack of covers. The stack guide rods preferably extend perpendicular to the plate 61 and thus project upwardly and forwardly as shown in FIGS. 4–6. A cover support is provided for supporting the bottom cover in each magazine with its underside in an inclined cover plane designated KP (FIG. 4) that converges in the direction of advance of the conveyors at a shallow acute angle. In the preferred embodiment illustrated, the cover support is in the form of a plate 68 attached to the underside of the base plate 61 as by fasteners 69, and which plate has portions which extend below the cover receiving openings 64 from the rear edge of the openings forwardly to a point slightly beyond the midpoint of the opening, as best shown in FIG. 10. The plate 68 thus underlies the bottom cover in the stack and supports the bottom cover in the inclined cover plane KP, which cover plane intersects the container plane CP at a cover-container intersect designated X (FIG. 4). The base plate 61 is substantially thicker than the depth of one of the covers K and the base plate is formed with a lateral passage that extends forwardly from the cover receiving opening and which passage has lateral cover guide walls 61*a* spaced apart a distance slightly greater than the diameter of the cover and a top cover guide wall 61*b* spaced above the cover plane a distance only slightly greater than the height of the cover to engage and guide the upper side of the bottom cover as it is moved forwardly through the lateral passage. Resilient fingers 71 (FIG. 10) are preferably provided in each of the lateral passages and biased inwardly to resiliently engage the outer rim of the bottom cover adjacent opposite sides thereof to releasably maintain the bottom cover in the magazine at a preset position along the inclined cover plane KP such that the leading edge of the container engaging rim on the bottom cover is disposed closely adjacent the point X where the cover plane intersects the container plane, as shown in FIGS. 4 and 5.

A cover shuttle 75 is provided on the magazine for moving the bottom cover off the magazine and for advancing the bottom cover into mating engagement with the rim on a container while the latter is advanced by the conveyor 21. The shuttle 75 is mounted for reciprocation in a recess 61*d* formed at the underside of the base plate 61 and it overlies the container support plate 68. The shuttle has a cover engaging nose 75*a* which is preferably curved as viewed in plan, as shown in FIG. 10 to conform to the curvature of the cover and which is preferably beveled as viewed in section in FIGS. 4–6, so that the shuttle engages the outer wall of the bottom cover in an area adjacent where it joins and is reinforced by the top wall 43*b* of the container engaging rim. The shuttle is reciprocated by a shuttle drive means operated in timed relation with the conveyor between a retracted position as shown in FIG. 4 in which the nose portion is disposed rearwardly of the bottom cover of the magazine, and an extended position in which the nose portion is moved at least part way across the lower end of the magazine a distance sufficient to advance the bottom cover crosswise of the magazine along the inclined cover plane KP to a position in which the lead edge of the container engaging rim on the bottom cover is disposed substantially forward of the point X where the cover plane intersects the container plane, as shown in FIG. 6. In accordance with the present invention, the shuttle drive means is so constructed and arranged that the forward velocity and displacement of the lead edge of the container engaging rim on the cover is approximately equal to the foward velocity and displacement of the lead edge of the container along the container path while the lead edge of the cover and container move past the point X where the cover and container planes intersect. The shuttle drive means includes a cross shaft 78 mounted as by brackets 79 on the base plate 61. A rod 81 is attached as by arms 82 to the shaft 78 for swinging movement with the shaft and the rod engages a yoke 84 attached to each shuttle to reciprocate the shuttle in response to oscillation of the shaft. The shuttle drive includes a cam 91 mounted on a shaft 92 and driven as by a power take-off 93 (FIG. 2) from the main drive shaft 34 in timed relation with the conveyor and such that the cam 91 is rotated through one revolution while the conveyor is advanced a distance corresponding to the pitch of the container receiving pockets on the conveyor. A cam follower, herein shown in the form of a roller 95 is mounted on an arm 96 that is pivotally supported on a pivot pin 97 on one of the mounting plates 62. The cam follower is yieldably biased into engagement with the cam by a spring 98 having one end attached to an anchor 99 on the arm and the other end attached to an anchor on the packaging machine. An adjustable link 102 is pivotally connected at one end as by a pin 103 to the arm 96 and at the other end as by a pin 104 to an arm 105 non-rotatably connected to the shaft 78. As best shown in FIG. 6, the arms 82 and 105 are angularly displaced approximately 90° from each other and are non-rotatably clamped to the shaft 78 as by screws 82*a* and 105*a* respectively. The adjustable link 102 has oppositely threaded end portions that threadedly engage end members 102*a* and 102*b* to enable adjustment of the effective length of the link. In addition, the cam member 91 is connected to the shaft 92 for limited angular adjustment as by circumferentially elongated openings 92*a* and fasteners 92*b* (FIG. 6).

Figure 11:
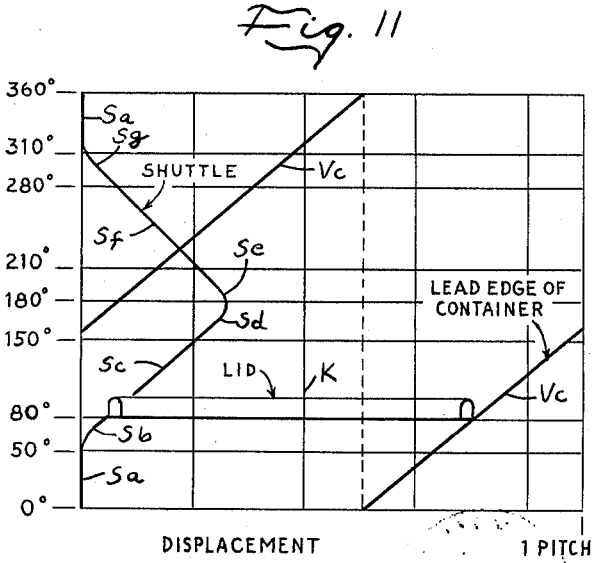
FIG. 11 is a graphical view illustrating displacement of the cover shuttle and container relative to the degrees of rotation of the shuttle drive cam.
Figure 12:
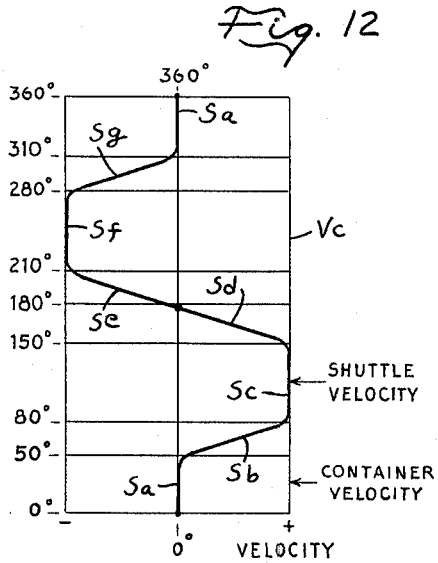
FIG. 12 is a graphical illustration of the cover shuttle and container velocity relative to the degrees rotation of the shuttle drive cam.

The cam 91 is shaped to reciprocate the shuttle from its rear position shown in FIG. 4 forwardly at least part way across the lower end of the magazine to advance the cover crosswise of the magazine along the cover plane to a position in which the bead edge of the container engaging rim of the bottom cover is disposed substantially forwardly of the point X at which the cover plane and container plane intersect, and the cam is so shaped that the forward velocity and displacement of the lead edge of the container engaging rim on the cover is approximately equal to the forward velocity and displacement of the lead edge of the container along the container path, while the lead edges of the cover and container move past the cover container intersect. As best shown in FIG. 6, the cam 91 has a dwell portion 91*a*, a forward acceleration portion 91*b*, a forward constant velocity portion 91*c*, a forward deceleration portion 91*d*, a rearward acceleration portion 91*e*, a rearward displacement portion 91*f*, and a rearward deceleration portion 91*g*. The shuttle movement produced by the cam is graphically illustrated in FIG. 11. When the follower 95 engages the dwell portion 91*a*, as shown in FIG. 4, the shuttle is in its retracted position designated S*a* in FIG. 11 and the shuttle is accelerated forwardly as indicated at S*b* in FIG. 11 as the forward acceleration portion 91*b* engages the follower 95. The shuttle is then moved forwardly at a constant velocity SC as the constant velocity portion 91*c* engages the follower 95 and this constant velocity is selected so as to be approximately equal to the velocity of the containers as they are moved by the conveyor past the cover applying apparatus. The forward velocity of the shuttle is decelerated as indicated at S*d* as the forward deceleration portion 91*d* moves past the follower, and the shuttle is then accelerated in the reverse direction as indicated at S*e* by the cam portion 91*e*. Rearward movement of the shuttle continues as indicated at S*f* as the cam portion 91*f* moves past the follower and the rearward movement of the shuttle is then decelerated as indicated as S*g* by the cam portion 91*g*. Portion 91*f* of the cam can conveniently be a constant velocity portion. As will be seen from the graphs in FIGS. 10 and 11, the velocity and displacement of the lead edge of the cover is substantially equal to the velocity and displacement of the lead edge of the container designated V*c* while the lead edges of the cover and container move past the point X where they intersect so that the cover can merge smoothly with the container. As the container continues movement along the path, the shuttle is initially retracted and then reversed so that it moves away from the cover. However, at least the lead portion of the cover and container have moved into substantially interfitting engagement by this time and the container can thereafter draw the cover off the stack.

The top cover guide wall 61*b* of the magazine engages the upper rim of the cover to press the cover onto the container as the container is advanced along the plane *KP* and a shoe 115 is mounted as by a bracket 116 on the magazine base to extend forwardly therefrom and to continue application of downward pressure of the cover. A rotary cover seating head 121 is conveniently provided at the outlet side of the cover applying apparatus 28. The rotary seating head is mounted for rotation about an axis 122 extending crosswise of the packaging machine, as by brackets 123. The head 121 has one or more cover engaging bosses 121*a* on its outer periphery arranged to engage the depressed mouth spanning portion of the cover to assure complete seating of the cover on the rim of the container. The cover seating head 121 is driven in timed relation with the conveyor as by a drive 124.

Figure 3:
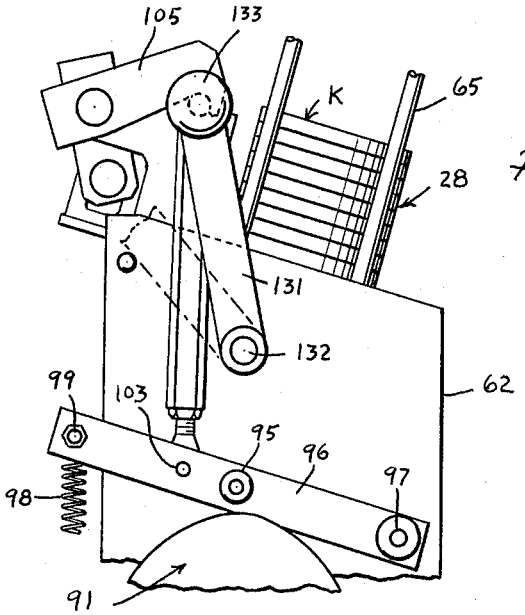
FIG. 3 is a fragmentary side elevational view of the cover applying apparatus, showing the shuttle drive disengaged.

Provision is also made for selectively disconnecting the shuttle drive to enable interruption of the capping operation. As shown in FIG. 3, a lever 131 is swingably mounted at 132 on one of the mounting plates 62 and is manually swingable as by a handle 133. The handle end of the lever is arranged to engage the underside of the arm 105 and come to rest against a stop 105*a* on the arm to raise the arm and thereby lift the lever 96 and cam follower out of engagement with the cam 91 as shown in FIG. 3.

From the foregoing it is believed that the construction and operation of the cover applying apparatus will be readily understood. The cover magazine supports the stack of covers with the bottom cover in a plane KP that is inclined downwardly and forwardly to intersect the plane CP of the top of the containers as the containers are advanced, and the shuttle 75 is reciprocated in timed relation with the conveyor to move the bottom cover crosswise of the stack and at a velocity substantially equal to the velocity of the containers as the lead edge of the covers and containers merge. Since the cover and container are moving at the same velocity and are in substantial registry as they merge, the downwardly opening rim 43 on the cover can interfit with the rim 39*a* on the container. Moveover, the cover and container are moving at substantially the same velocity at the point of merger, so that the cover does not impose any substantial drag on the container while the lead edges are moving into interfitting relation. In addition, since the covers are positively moved from the cover magazine into interfitting relation with the containers, high speed operation can be achieved.

We claim:

1. An apparatus for applying covers having a central mouth spanning portion and a peripheral container engaging rim to containers comprising: conveyor means for advancing containers along a container path past a cover applying station with the containers spaced apart along the container path and with the tops of the containers in a preselected container plane, a cover magazine overlying the conveyor means at the cover applying station, said cover magazine having cover support means at its lower end for supporting the bottom cover in the magazine with its underside in an inclined cover plane that converges in the direction of advance of the conveyor means at an acute angle relative to said container plane, said inclined cover plane intersecting said container plane at a cover-container intersect and said cover magazine releasably maintaining the bottom cover in the magazine at a preset position along said inclined cover plane such that the leading edge of the container engaging rim on the bottom cover is disposed adjacent the cover-container intersect, a cover shuttle having a cover engaging nose at its forward end and mounted for reciprocation along an inclined path paralleling said inclined cover plane, shuttle drive means operated in timed relation with said conveyor means for reciprocating the cover shuttle between a retracted position in which the nose portion is disposed rearwardly of the bottom cover in the magazine and an extended position in which the nose portion is moved at least part way across the lower end of the magazine a distance sufficient to advance the bottom covers crosswise of the magazines along said inclined cover planes to a position in which the lead edge of the container engaging rim on the bottom cover is disposed substantially forward of the cover-container intersect, said shuttle drive means being so constructed and arranged that the forward velocity and displacement of the lead edge of the container engaging rim on the cover is approximately equal to the forward velocity and displacement of the lead edge of the container along the container path while the lead edges of the cover and container move past the cover-container intersect.

2. An apparatus for applying covers according to claim 1 wherein said shuttle drive means includes cam means driven in timed relation with said conveyor means.

3. An apparatus for applying covers according to claim 1 wherein said shuttle drive means includes a rotary cam member rotated in timed relation with said conveyor means.

4. An apparatus for applying covers to containers according to claim 1 including means extending forwardly from the cover magazine for guidably engaging the top of a cover as it is moved off the magazine to press the cover downwardly onto the container.

5. An apparatus for applying covers to containers according to claim 1 wherein the cover magazine includes a base having a cover receiving opening and cover stack guide means extending upwardly from the base around the cover receiving opening, said cover support means including a bottom cover guide having its upper side underlying a portion of the cover receiving opening and disposed in said inclined cover plane to underlie the bottom cover in the stack, said base having lateral passage means extending forwardly from said cover receiving opening and dimensioned to allow the bottom cover to be moved edgewise therethrough, said cover shuttle being mounted for reciprocation across the upper side of said bottom cover guide, and top cover guide means in said passage means spaced above said inclined cover plane a distance corresponding to the height of a cover to engage and guide the upper side of the bottom cover as it is moved through said lateral passage means.

6. An apparatus for applying covers according to claim 1 wherein covers are of the type having a container engaging rim in the form of a downwardly opening peripheral channel, the bottom cover in said preset position along the inclined cover path having lowermost portion of its container engaging rim disposed closely adjacent to said container plane.

7. An apparatus for applying covers to containers according to claim 1 wherein said cam means includes a rotary cam having a peripheral cam track, a follower mounted for movement along a follower path generally radially of said rotary cam, means yieldably biasing said follower in one direction into engagement with the cam track whereby the follower is normally moved along the follower path under the control of said cam track, said shuttle drive means including means operatively connecting the follower to the shuttle for moving the shuttle when the follower is moved along the follower path, and manually operable means for moving the cam follower in said one direction to an inoperative position out of the path of the cam track and for locking said cam follower in said inoperative position.

8. An apparatus for applying covers to containers according to claim 1 wherein said shuttle drive means includes a shaft mounted on said cover magazine and extending crosswise of the path of reciprocation of the shuttle, means including an arm on said shaft engaging said shuttle to reciprocate the shuttle in response to rocking of the shaft about its axis, and means operatively connecting said rotary cam to said shaft to rock the shaft about its axis.

* * * * *